United States Patent [19]

Morales

[11] Patent Number: 4,508,307

[45] Date of Patent: Apr. 2, 1985

[54] FOLDABLE, SELF-SUPPORTING, ADJUSTABLE BOOK HOLDER

[76] Inventor: Liborio D. Morales, 815 Marilla St., Santa Barbara, Calif. 93101

[21] Appl. No.: 623,249

[22] Filed: Jun. 22, 1984

[51] Int. Cl.[3] ..... A47B 97/04

[52] U.S. Cl. ..... 248/460; 248/448; 248/454

[58] Field of Search ..... 248/460, 462, 463, 454, 248/448, 449, 442, 441.1

[56] References Cited

U.S. PATENT DOCUMENTS

| | | | |
|---|---|---|---|
| 1,197,233 | 9/1916 | Plamondon et al. | 248/453 |
| 2,570,439 | 10/1951 | Forca | 248/452 |
| 3,376,009 | 4/1968 | Domino | 248/460 X |
| 4,296,946 | 10/1981 | Larre et al. | 248/451 X |

FOREIGN PATENT DOCUMENTS

| | | | |
|---|---|---|---|
| 457459 | 9/1913 | France | 248/460 |
| 1480450 | 7/1977 | United Kingdom | 248/460 |

*Primary Examiner*—J. Franklin Foss

*Attorney, Agent, or Firm*—Daniel J. Meaney, Jr.

[57] ABSTRACT

A foldable, self-supporting, adjustable book holder is disclosed having a first base member formed of an elongated base section having a planar portion which deflects at a bend into an elevated, substantially parallel elongated member wherein the elevated, elongated support member has an elongated slot formed therein which is adapted to receive an elevated boss positioned within and movable within the elongated slot, a second base member having an elongated, substantially planar support member having an elevated boss member formed at one end thereof which is adapted to be positioned into and slidable within the elongated slot, a pair of side members which are adapted to be pivotally connected to the ends of the first base member and the second base member such that the elevated boss is positioned in and is movable with the elongated slot to form a book support when in upright position and wherein the opposite ends of the side members have a plurality of axially aligned openings formed therein to receive an elongated adjustable rod member and an elongated holding and support member having a protruding lip formed at the other end thereof to form a three-point loading system to support a book. The foldable, self-supporting, adjustable book holder is adapted to be formed into a folded, compact book holder.

7 Claims, 9 Drawing Figures

FOLDABLE, SELF-SUPPORTING, ADJUSTABLE BOOK HOLDER

BACKGROUND OF THE INVENTION

1. Field of the Invention

This invention relates to a self-supporting, adjustable book holder and, more particularly, to a compact, foldable, self-supporting, adjustable book holder which is adapted to have an adjustable base which can vary in length, a removable elongated rod member which cooperates with a protruding lip forming an elongated holding and support member to define a three-point support system for reading material.

2. Description of the Prior Art

Book holders are well known in the art. There are many known book holders which are formed of three components which comprise an elongated strip member having a pivotal supports located at each end thereof and each of which is adapted to receive vertically extending spaced rod members which terminate in horizontal supports having protruding lips at the end thereof which define a support for the book holder. The protruding lips are adapted to receive and hold the bottom of a book and cooperate with the elongated strip member to form a three-point loading system.

Other book holders are known in the art which take the form of an angled support holder, or stand, such as a podium or the like. The holder or stand may have an elongated support member to enable a reader to read a book in a standing position.

SUMMARY OF THE PRESENT INVENTION

This invention provides a novel, unique and improved foldable, self-supporting, adjustable book holder. In the preferred embodiment, the foldable, self-supporting, adjustable book holder comprises a first base member having an elongated base section which extends a predetermined distance from a first end to a bend wherein the remaining portion of the elongated base section defines an elevated, substantially parallel, elongated support section. The elongated support section has a length which is at least equal to the predetermined distance and has located along the axis thereof an elongated slot which extends from about the bend to about the second end of the elongated base section. The elongated slot is adapted to slidably receive therein the elongated boss, which is movable within and along the elongated slot. A second base member is provided having an elongated planar support member which extends from between a first end and a second end a distance at least equal to the predetermined distance. The second end of the second base member has formed therein an elevated boss which is adapted to be positioned in and movable within the elongated slot to vary the distance between the first end of the first base member and the first end of the second base member. The second end of the second base member further includes means defining an elongated fastening means which is located adjacent the elongated boss and towards the first end of the second base member. A pair of side members are provided, one of each of which has one end thereof pivotally connected to the first end of the first base member and the first end of the second base member. The ends of the pair of side members are adapted to be movable between an unfolded position wherein the side members are positioned in a space, opposed relationship to each other and into a folded position wherein each side member is rotated around its pivotable axis towards each other, towards the first base member and the second base member, into a folded position wherein each of the side members is located on a common plane which is substantially parallel to the first base member and the second base member. Each of the side members terminates at one end thereof opposite the end pivotally connected to the first base member and the second base member, at least one opening of which is formed therein and which extends therethrough. Each of the openings on each end is in axial alignment with the opening formed in the opposite end of the spaced, paralled side members when the same are in an unfolded position. The holder includes an elongated, adjustable rod member, which is adjustable in length along its axial length as distance in excess of the greatest distance between the first end of the first base member and the second end of the second base member. The elongated adjustable rod member has a cross-sectional dimension at each end thereof such that it will pass through the opening formed at each of the side members and which has sufficient rigidity to support a book. An elongated holding and support member is provided which has a first extended portion having an elongated slot therein to cooperate with the fastening means to permit the elongated holding and support means to be located at a position which is substantially normal to the first base member and the second member. The elongated holding and support member has its other end formed into a protruding lip which extends in a direction away from the first base member and the second base member. The elongated, adjustable rod member is adapted to be rotatable around said fastening means and to be movable along its elongated slot relative to said fastening means into a position which is above and positioned into a substantially parallel plane defined by the side members when in the folded position. The elongated, adjustable rod member and the protruding lip, when the same are in an unfolded position, provide a three-point support which is adapted to receive and support a book at a selected reading angle determined by the selected position of the elongated adjustable rod member relative to the ends of the side members and the distance that the protruding lip is located away from said first base member and said second base member.

None of the known prior art book holders are adapted to be folded into an integrated, compact, secured unit which can be easily assembled into an unfolded position to support reading material.

One advantage of the present invention is that the first and second base members are slidable relative to each other to accommodate a large variety of books which have varying widths and wherein the elongated, adjustable rod member is likewise adjustable over a distance which is greater than the adjustable distance of the base member, to provide an elongated support for the book.

Another advantage of the present invention is that the elongated holding and support member can be varied such that the protruding lip can be selected at a predetermined distance from the first base member and the second base member such that the angle of the book can be controlled and positioned at a selected reading angle.

A further advantage of the present invention is that the book holder is self-supporting by a three-point support system defined by the elongated holding and support member and the ends of the first and second base members such that the book holder is stable and wherein a second three-point support system is provided to support a book wherein the elongated, adjustable rod member provides two points of support for a book, while the protruding lip of the elongated holding and support member provides the third support point.

A yet further advantage of the present invention is that a threaded member can have sufficient length such that all elements, including the elongated, adjustable rod member, can be passed therethrough and the unit can be held into a tight, unitary assembly by tightening of a knot against the threaded member.

A yet further advantage of the present invention is that each of the side support members has a plurality of holes to vary the distance between the axis of the elongated, adjustable rod member relative to the first and second base members wherein, by movement of the elongated, adjustable rod member to holes which are further away from the first base member or the second base member, the top of a book can be moved closer to the viewer to provide a sharper reading angle relative to such viewer.

DESCRIPTION OF THE PREFERRED EMBODIMENT

Figure 1:
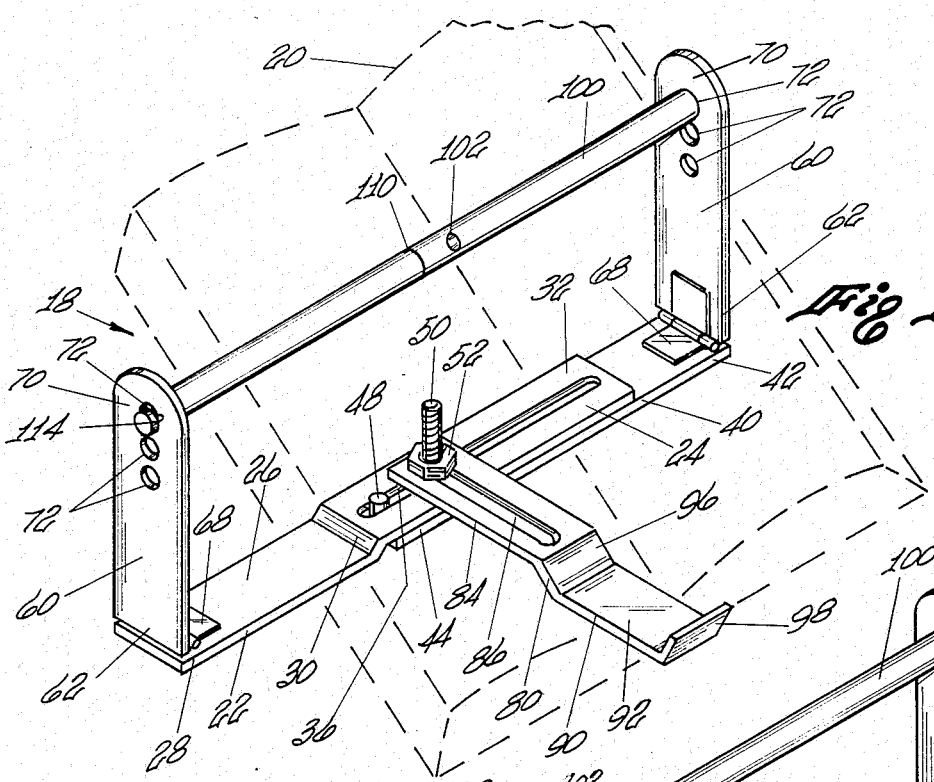
FIG. 1 is a front perspective view of a foldable, self-supporting, adjustable book holder showing my new invention.

FIG. 1 illustrates the foldable, self-supporting, adjustable bookholder 18 which is adapted to support a book illustrated by a phantom book 20. The book 20 is adapted to be held at an angle relative to a viewer. The foldable, self-supporting, adjustable book holder comprises a first base member 22 having an elongated base section 26 which extends a predetermined distance from a first end 28 to a bend 30 wherein the remaining portion of the elongated base section 24 defines an elevated, substantially parallel, elongated support section. The elongated support section 24 has a length which is at least equal to the predetermined distance of the first portion of the elongated base section 22. The elevated, substantially parallel support section 24 includes means for defining, along the axis thereof, an elongated slot 36 which extends from about the bend 30 to about the second end 32. The elongated slot 36 is adapted to slidably receive therein an elevated boss 40 which is movable within and along the elongated slot 36. The foldable, self-supporting, adjustable book holder includes a second base member having an elongated planar support member 40 which extends between a first end 42 and a second end 44 wherein the distance therebetween is at least equal to the predetermined distance of the first section of the first base member 22. The second end 44 of the second base member 40 has formed therein an elevated boss 48 which is adapted to be positioned in and movable within the elongated slot 36 of the elevated, substantially parallel member 24 of the first base member 22. The elevated boss 48 is adapted to be positioned in and movable within the elongated slot 36 to vary the distance between the first end 28 of the first base member 22 and the first end 42 of the second base member 40. The second end 44 further includes means for defining an elongated fastening means, such as an elongated threaded member 50, which is located adjacent the elevated boss 48 and is positioned toward the first end 42 of the second base member.

Figure 9:
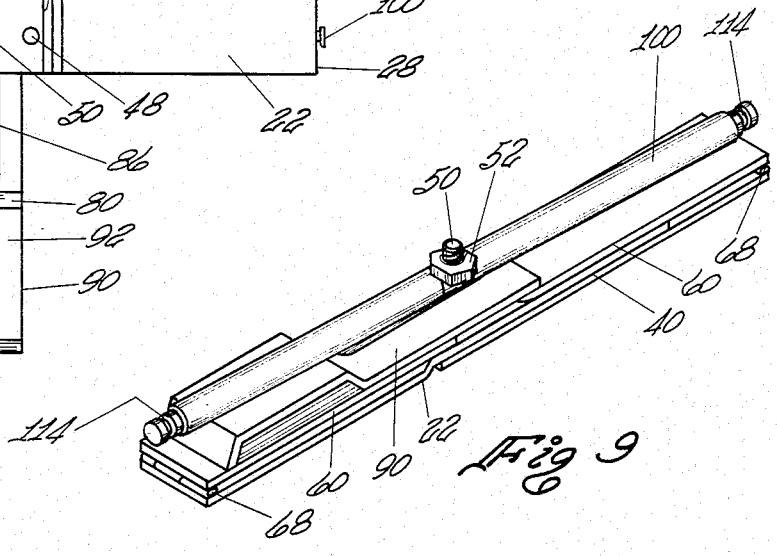
FIG. 9 is the foldable, self-supporting, adjustable book holder in a folded position.

A pair of side members, each identified as side member 60, is positioned such that one of each of the pair of side members 60 has one end thereof 62 pivotally connected, such as by hinges 68, to the first end of the first base member and the first end of the second base member. The side members 60 are movable relative to the first base member and the second base member between an unfolded position as illustrated in FIGS. 1 through 8, wherein the side members 60 are positioned in a substantially parallel, spaced relationship to each other and are adapted to be moved into a folded position, such as that illustrated in FIG. 9, wherein each of the side members is rotated around a pivotal axis defined by the hinges 68. Each of the side members is movable toward each other and toward the first base member 22 and the second base member 42 into a folded position. The folded position is illustrated in FIG. 9. In FIG. 9, each of the side members is located on a common plane which is subtantially parallel to the plane defined by the first base member 22 and the second base member 40.

As illustrated in FIGS. 1, 2, 4, and 5, each of the side members 60 at the ends opposite to the first base member 22 and the second base member 40 has at least one opening formed therein which extends therethrough. Each of the openings are positioned in axial alignment with a similarly disposed opening in the spaced, opposed side members when the same are in an unfolded position.

An elongated, adjustable rod member 110 is illustrated in FIGS. 1 through 3, 6, and 8 and is able to be adjusted in length along its axial length a distance in excess of the greatest distance between the first end 28 of the first base member 22 and the first end 42 of the second base member 40. The elongated, adjustable rod member 100 has a cross-sectional dimension at the ends thereof such that the ends thereof will pass through an opening 72 formed in each end 70 of each side member. The elongated, adjustable rod 100 has sufficient rigidity to support a book.

As illustrated in FIGS. 1 through 3, 6, and 8, in the preferred embodiment, the elongated, adjustable rod member 100 has a substantially uniform cross section and is formed to be telescoping in shape, as illustrated by telescoping sections joined at common area 110. However, it is envisioned that the elongated, adjustable rod member could have a central portion having a greater cross-sectional area than the end portions, the important feature of this invention being that the end portions thereof have a cross-sectional area such that the ends will pass through the opening 72 in each of the side members 60.

An elongated holding and support member 90 having a first extended portion 84 having an elongated slot 86 formed therein is adapted to cooperate with the fastening means, such as the threaded member 50, such that the threaded member 50 will pass through the elongated slot 86. The elongated holding and support means 90 is adapted to be positioned at an angle substantially normal to the first base member 22 and the second base member 40. The elongated holding and support member 90 has its other end thereof formed into a substantially "U" shape wherein the first side thereof 80 is adapted to cooperate with the elongated portion 84 and the other side of the U-shaped member forms a protruding lip 98. The protruding lip 98 is adapted to extend in a direction away from the first base member 22 and the second base member 40.

As illustrated in FIGS. 1 through 3 and 6, the elongated, adjustable rod member 100 has two sections forming the telescoping section thereof have internal holes 102 therein aligned, the aligned elongated, adjustable rod member 100 can be placed over the threaded member 50, as illustrated in FIG. 9, to enable the entire unit to be folded into a compact, easily transportable unit.

Figure 2:
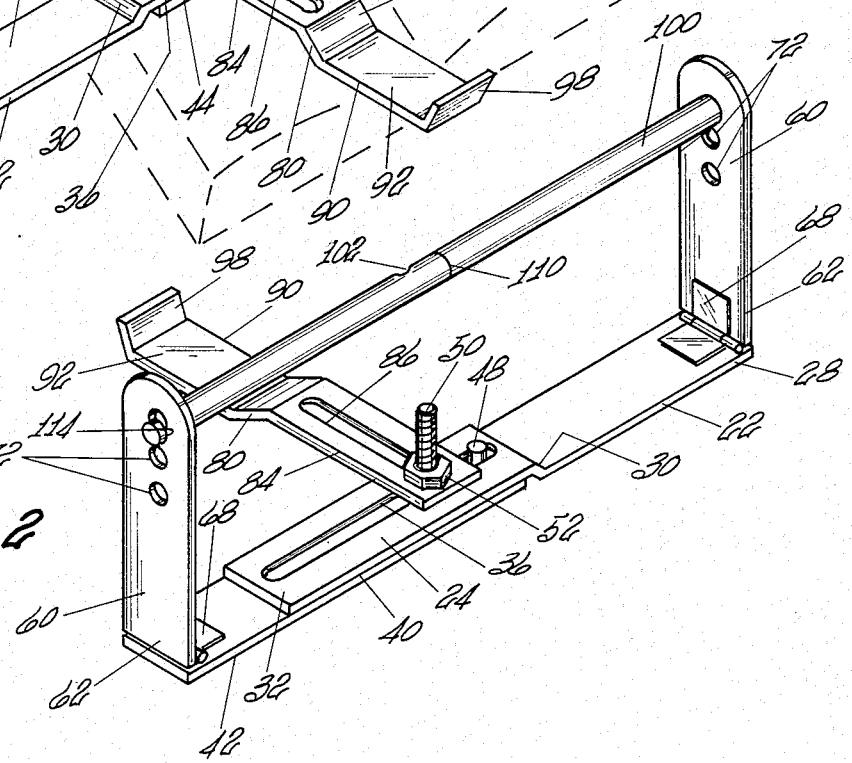
FIG. 2 is a back perspective view thereof.
Figure 3:
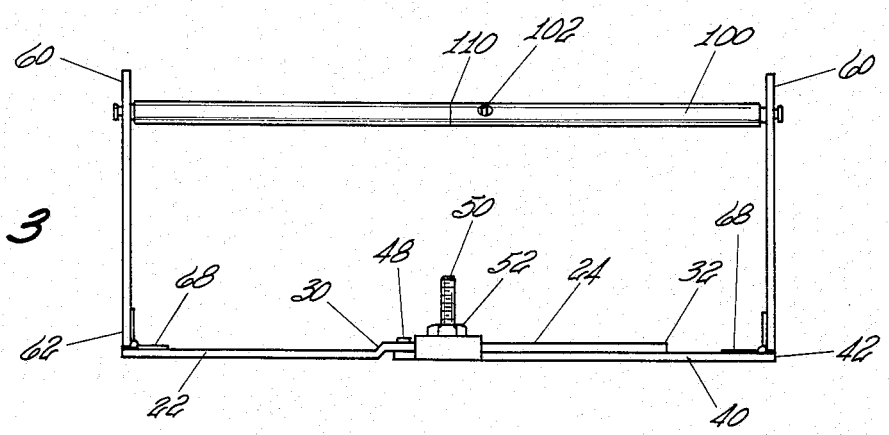
FIG. 3 is a front elevational view thereof.
Figure 4:
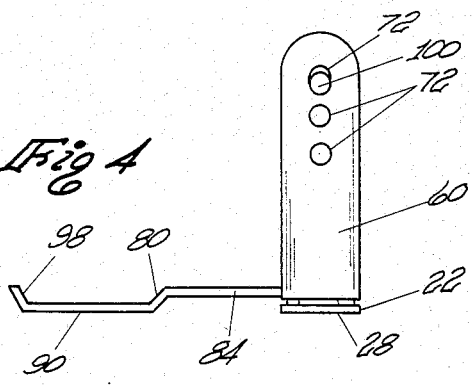
FIG. 4 is a right-side elevational view thereof.
Figure 5:
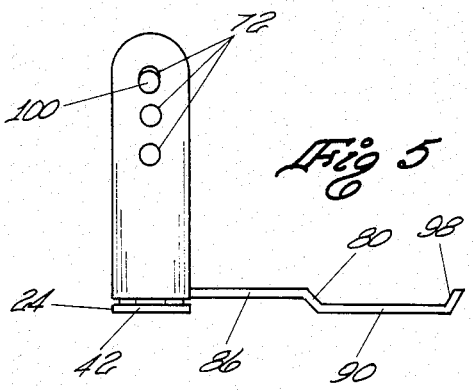
FIG. 5 is a left-side elevational view thereof.
Figure 6:
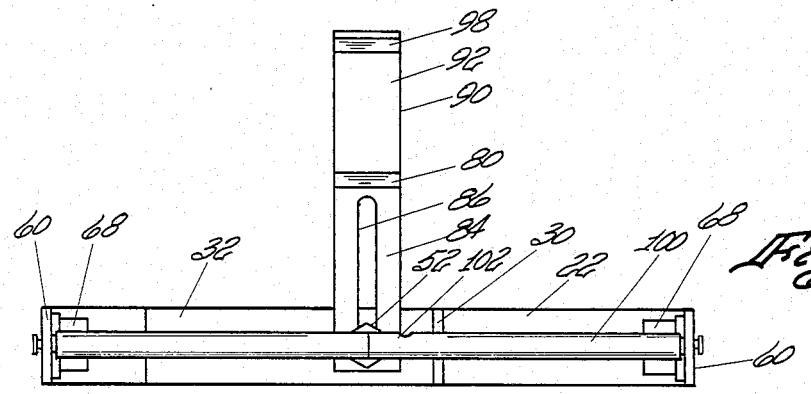
FIG. 6 is a top plan view thereof.
Figure 8:
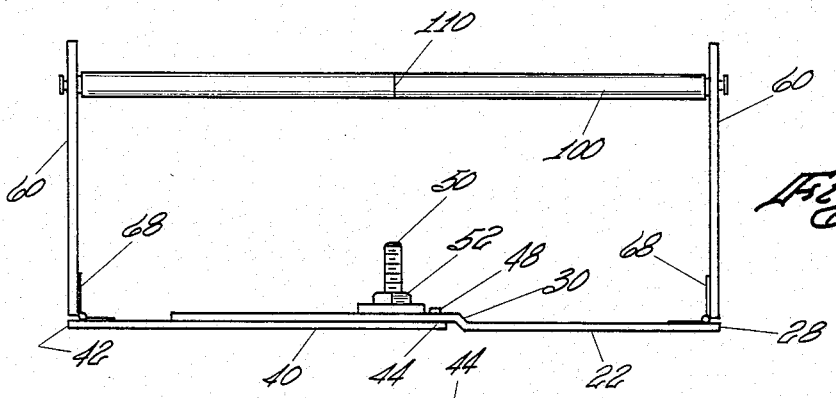
FIG. 8 is a rear elevational view thereof.
Figure 7:
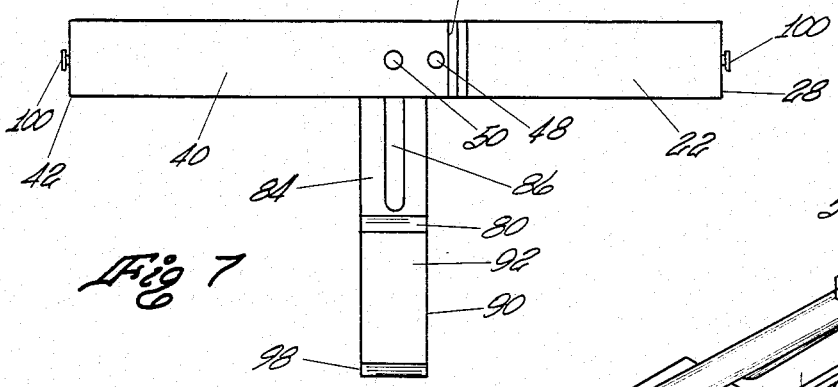
FIG. 7 is a bottom plan view thereof.

As illustrated in detail in FIG. 9, the ends of the elongated, adjustable rod member 100 have a groove 114 formed around the periphery thereof which is adapted to cooperate with the edge of the end 70 defining the holds so as to form a mechanical support therebetween. The slip fit between the periphery 114 and the edge of the holes defined by upper end 70 are illustrated in FIGS. 1 and 2.

Referring to FIG. 9, the foldable, self-supporting, adjustable book holder forms a very tight, compact unit when in the folded position. In the folded position, the first base member 22 and the second base member 40 are substantially in a planar relationship. The side members 60 when folded about the hinges 60 are formed into a common plane. The elongated holding and support member 90 is rotated in a manner such that it is in a plane which is substantially parallel to the plane defined by side 60 and the first movable base 22 and the second movable base 40. The elongated, adjustable rod member 100 is adjusted such that the opening 102 will pass the elongated thread member 50. The nut 52 then is tightened to hold the entire assembly together in a tight, compact arrangement.

As illustrated in FIG. 1, the angle of the book can be controlled in a number of ways. First, the height or distance between the elongated, adjustable rod member 100 and the first base member 22 and the second base member 40 can be varied by moving the rod member between the various holes. The holes can have the centers thereof positioned in a spaced, parallel relationship where, in the preferred embodiment, the distance between hole centers is equal. Also, the elongated guiding and support members can have the protruding lip 98 moved away from or toward the first base member 22 and the second base member 40 such that the protruding lip 90 will vary the angle of the bottom end of the book 20. Thus, the angle to be selected by a viewer can be determined by adjusting the distance of the elongated, adjustable rod member 100 by positioning the same in one of the sets of openings in the end 70 of the side member 60 or by varying the distance of the protruding lip 98 relative to the first base member 22 and the second base member 40.

In the preferred embodiment, the foldable, self-supporting adjustable book holder can be formed of metal. However, it is envisioned that each of the elements, including the fastening means, could be formed of sturdy plastic. Also, if desired, the elongated support member can have a central area other than circular in cross section, such as elliptical or rectangular, with the ends thereof having a selected geometrical dimension such that the ends thereof will pass through the opening 72 and the end 70 of the side member 60.

What is claimed is:

1. A foldable, self-supporting, adjustable book holder comprising:

a first base member having an elongated base section which extends a predetermined distance from a first end to a bend wherein the remaining portion of the elongated base section defines an elevated, substantially parallel elongated support section ending in a second end, said elongated support section having a length at least equal to said predetermined distance and having located along the axis thereof an elongated slot which extends from about the bend to about the second end of the elongated base section and which is adapted to slidably receive therein an elevated boss which is movable within and along said elongated slot;

a second base member having an elongated planar support member which extends between a first end and a second end a distance which is at least equal to said predetermined distance, said second end of said second base member having formed therein an elevated boss which is adapted to be positioned in and movable within said elongated slot to vary the distance between said first end of said first base member and the first end of said second base member, said second end further including means defining the elongated fastening means which is located adjacent elongated boss and toward said second end of said second base member;

a pair of side members, one of each of which has one end thereof pivotally connected to said first end of said first base member and said first end of said second base member so as to be movable between an unfolded position, wherein said side members are positioned in a substantially parallel, spaced, opposed relationship to each other, into a folded position wherein each side member is rotated around this pivotal axis toward each other and toward said first base member and said second base member into a common plane with each other and which is substantially parallel to the plane defined by said first base member and said second base member, said side members each terminating at one end thereof opposite to said end which is pivotally connected to said first base member and said second base member, having at least one opening formed therein which extends therethrough which is in axial alignment with the opening formed in the opposite side member when the side members are positioned in the unfolded position;

an elongated, adjustable rod member which is adapted to be adjustable in length along its axial axis and adjustable a distance in excess of the greatest distance between said first end of said first base member and the first end of said second base member, said elongated adjustable rod member having a cross-sectional dimension such that the end thereof will pass through said opening in each of said side members and which has sufficient rigidity when passing therethrough to support a book; and an elongated holding and support member having a first extended portion which has the elongated slot therein to cooperate with said fastening means to prevent said elongated holding and support means to be located at a substantially normal position relative to said first base member and said second base member, said elongated holding and support member having its other end formed into a protruding lip which extends in a direction away from said first base member and said second base member, said first extended portion of said elongated holding and support member being rotatable around said fastening means and adapted to have such fastening means slide within its elongated slot such that the elongated holding and support member is positioned above said side members and in a plane substantially parallel thereto when said elongated holding and support member is moved into a folded position, said elongated adjustable rod member and said protruding lip, when located in an unfolded position, providing a three-point support system which is adapted to receive and support a book at a selected reading angle which is determined by the relative position of the elongated, adjustable rod member within the opening as defined in said side members and the distance said protruding lip is located away from said first base member and said second base member.

2. The foldable, self-supporting, adjustable book holder of claim 1 wherein elongated holding and support member is formed into a generally U-shaped member having one of its ends cooperating with the elongated lip member having the elongated slot therein and the other of its ends which defines said protruding lip.

3. The foldable, self-supporting, adjustable book holder of claim 1 further comprising hinge means operatively coupled between said first end of said first base member and said first end of said second base member and the ends of said side members, which are adapted to permit the ends of said side members to pivot therearound.

4. The foldable, self-supporting, adjustable book holder of claim 1 wherein each of said side members has three spaced openings formed therein wherein the axes thereof are located in a spaced, parallel relationship having a predetermined distance therebetween.

5. The foldable, self-supporting, adjustable book holder of claim 1 wherein the spacing between each of the centers of the openings is equidistant.

6. The foldable, self-supporting, adjustable book holder of claim 1 wherein said fastening means includes a threaded member having a cross-sectional area which permits the same to extend from said second end of said second base member through the elongated slot wherein the length of the threaded member has sufficient length to pass through the elongated slot formed in said elongated holding and support member first extended portion; and a nut adapted to be threaded upon said threaded member such that when said nut is tightened along said threaded member it clamps against and supports the elongated holding and support member at a substantially normal position relative to said first base member and said second base member.

7. The foldable, self-supporting, adjustable book holder of claim 6 wherein said elongated, adjustable rod member includes an opening which extends through the member and which is adapted to be positioned upon said threaded member such that when the foldable, self-supporting, adjustable book holder is in a folded position, the elongated, adjustable rod member is adapted to receive and pass said elongated threaded member and wherein said nut is adapted to be tightened thereagainst to keep said foldable, self-supporting, adjustable book holder in its folded position.

* * * * *